US010535956B2

(12) United States Patent
Henry et al.

(10) Patent No.: US 10,535,956 B2
(45) Date of Patent: Jan. 14, 2020

(54) ELECTRICAL DEVICE HAVING AN IMPEDANCE CONTROL BODY

(71) Applicant: TE CONNECTIVITY CORPORATION, Berwyn, PA (US)

(72) Inventors: Randall Robert Henry, Lebanon, PA (US); Dustin Grant Rowe, Harrisburg, PA (US); Robert Harrison Wertz, Jr., Mechanicsburg, PA (US); Julia Anne Lachman, York, PA (US); Jeff Swartzbaugh, Dover, PA (US); Christopher Michael Pogash, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/915,466

(22) Filed: Mar. 8, 2018

(65) Prior Publication Data

US 2019/0280435 A1 Sep. 12, 2019

(51) Int. Cl.

| | |
|---|---|
| ***H01R 13/6473*** | (2011.01) |
| ***H01R 13/424*** | (2006.01) |
| ***H01R 13/58*** | (2006.01) |
| ***H01R 13/6592*** | (2011.01) |

(52) U.S. Cl.

CPC ..... *H01R 13/6473* (2013.01); *H01R 13/424* (2013.01); *H01R 13/582* (2013.01); *H01R 13/6592* (2013.01)

(58) Field of Classification Search

CPC .. H01R 13/424; H01R 13/514; H01R 13/582; H01R 13/6473; H01R 13/6476; H01R 13/6592

See application file for complete search history.

(56) References Cited

U.S. PATENT DOCUMENTS

| | | | | |
|---|---|---|---|---|
| 4,083,615 | A * | 4/1978 | Volinskie | H01R 12/675 439/402 |
| 4,367,005 | A * | 1/1983 | Douty | H01R 13/582 439/357 |
| 4,615,578 | A * | 10/1986 | Stadler | H01R 12/775 439/607.47 |
| 6,857,899 | B2 * | 2/2005 | Reed | H01R 13/6593 439/497 |
| 6,893,295 | B1 | 5/2005 | Lloyd et al. | |
| 6,984,150 | B2 | 1/2006 | Kondou et al. | |
| 7,906,730 | B2 * | 3/2011 | Atkinson | H01R 13/6592 174/78 |
| 9,004,957 | B2 | 4/2015 | Aizawa et al. | |

(Continued)

*Primary Examiner* — Oscar C Jimenez

(57) ABSTRACT

An electrical device includes an organizer having a dielectric body including an upper surface and a lower surface supporting ends of cables having signal wires and having conductors on the upper surface and on the lower surface being electrically connected to corresponding signal wires. The electrical device includes an impedance control body separate and discrete from the dielectric body and coupled to the dielectric body of the organizer. The impedance control body has an upper pad on the upper surface covering the conductors and signal wire on the upper surface and a lower pad on the lower surface covering the conductors and signal wires on the lower surface. The impedance control body has a connecting tab passing through a void in the organizer between the upper pad and the lower pad.

20 Claims, 5 Drawing Sheets

(56) References Cited

U.S. PATENT DOCUMENTS

| | | | | |
|---|---|---|---|---|
| 9,742,088 | B1 * | 8/2017 | Pickel | H01R 13/03 |
| 2004/0229510 | A1 * | 11/2004 | Lloyd | H01R 9/032<br>439/607.01 |
| 2009/0176400 | A1 * | 7/2009 | Davis | H01R 13/506<br>439/352 |
| 2013/0188325 | A1 * | 7/2013 | Garman | H05K 9/0007<br>361/753 |
| 2015/0079845 | A1 * | 3/2015 | Wanha | H01R 13/6477<br>439/607.41 |
| 2018/0006416 | A1 * | 1/2018 | Lloyd | H05K 7/1487 |

* cited by examiner

ELECTRICAL DEVICE HAVING AN IMPEDANCE CONTROL BODY

BACKGROUND OF THE INVENTION

The subject matter herein relates generally to impedance control for an electrical device.

Communication cables electrically couple to various types of electrical devices to transmit differential signals, such as connectors and circuit boards. For example, the electrical devices may be receptacle connectors having a receptacle and contacts arranged in the receptacle for mating with a mating electrical device. The electrical devices may be plug connectors having contacts or conductors configured to be plugged into mating electrical devices. The cables are electrically connected to the contacts or conductors. Electrical performance of some known electrical devices may be inadequate, such as for high-speed electrical devices. For example, electrical shielding may be difficult. Impedance control may be difficult for high-speed signal lines.

Accordingly, there is a need for an electrical device having impedance control.

BRIEF DESCRIPTION OF THE INVENTION

In one embodiment, an electrical device is provided including cables having signal wires and an organizer having a dielectric body including an upper surface and a lower surface supporting ends of the cables on the upper surface and on the lower surface. The organizer having a void extending between the upper surface and the lower surface. Conductors are provided on the upper surface and on the lower surface having mating ends configured for mating with a mating electrical device and being electrically connected to corresponding signal wires. The electrical device includes an impedance control body coupled to the dielectric body of the organizer. The impedance control body has an upper pad on the upper surface covering at least a portion of each conductor on the upper surface and covering at least a portion of each signal wire of the cables supported by the upper surface. The impedance control body has a lower pad on the lower surface covering at least a portion of each conductor on the lower surface and covering at least a portion of each signal wire of the cables supported by the lower surface. The impedance control body has a connecting tab passing through the void between the upper pad and the lower pad. The impedance control body is separate and discrete from the dielectric body of the organizer.

In another embodiment, an electrical device is provided including an organizer having a dielectric body including an upper surface and a lower surface and having a void extending between the upper surface and the lower surface. Upper conductors are provided on the upper surface having mating ends configured for mating with a mating electrical device and lower conductors are provided on the lower surface having mating ends configured for mating with the mating electrical device. Upper cables are supported by the upper surface having upper signal wires and lower cables are supported by the lower surface having lower signal wires. An impedance control body is coupled to the dielectric body of the organizer. The impedance control body has an upper pad on the upper surface covering at least a portion of each upper conductor and covering at least a portion of each upper signal wire. The impedance control body has a lower pad on the lower surface covering at least a portion of each lower conductor and covering at least a portion of each lower signal wire. The impedance control body has a connecting tab passing through the void between the upper pad and the lower pad. The impedance control body is separate and discrete from the dielectric body of the organizer.

In a further embodiment, an electrical device is provided including a housing having a cavity and a mating end with a slot at the mating end providing access to the cavity and configured to receive a mating electrical device. Cables extend from a cable end of the housing each having a signal wire. An organizer is received in the cavity having a dielectric body including an upper surface and a lower surface. The organizer supports ends of the cables on the upper surface and on the lower surface. The organizer has a void extending between the upper surface and the lower surface. Conductors are provided on the upper surface and on the lower surface having mating ends arranged within the slot for mating with the mating electrical device and being electrically connected to corresponding signal wires. The electrical device includes an impedance control body separate and discrete from the dielectric body of the organizer and being coupled to the dielectric body of the organizer. The impedance control body has an upper pad, a lower pad and a connecting tab between the upper pad and the lower pad passing through the void between the upper pad and the lower pad. The impedance control body covers at least a portion of each conductor and covering at least a portion of each signal wire of the cables.

DETAILED DESCRIPTION OF THE INVENTION

Figure 1:
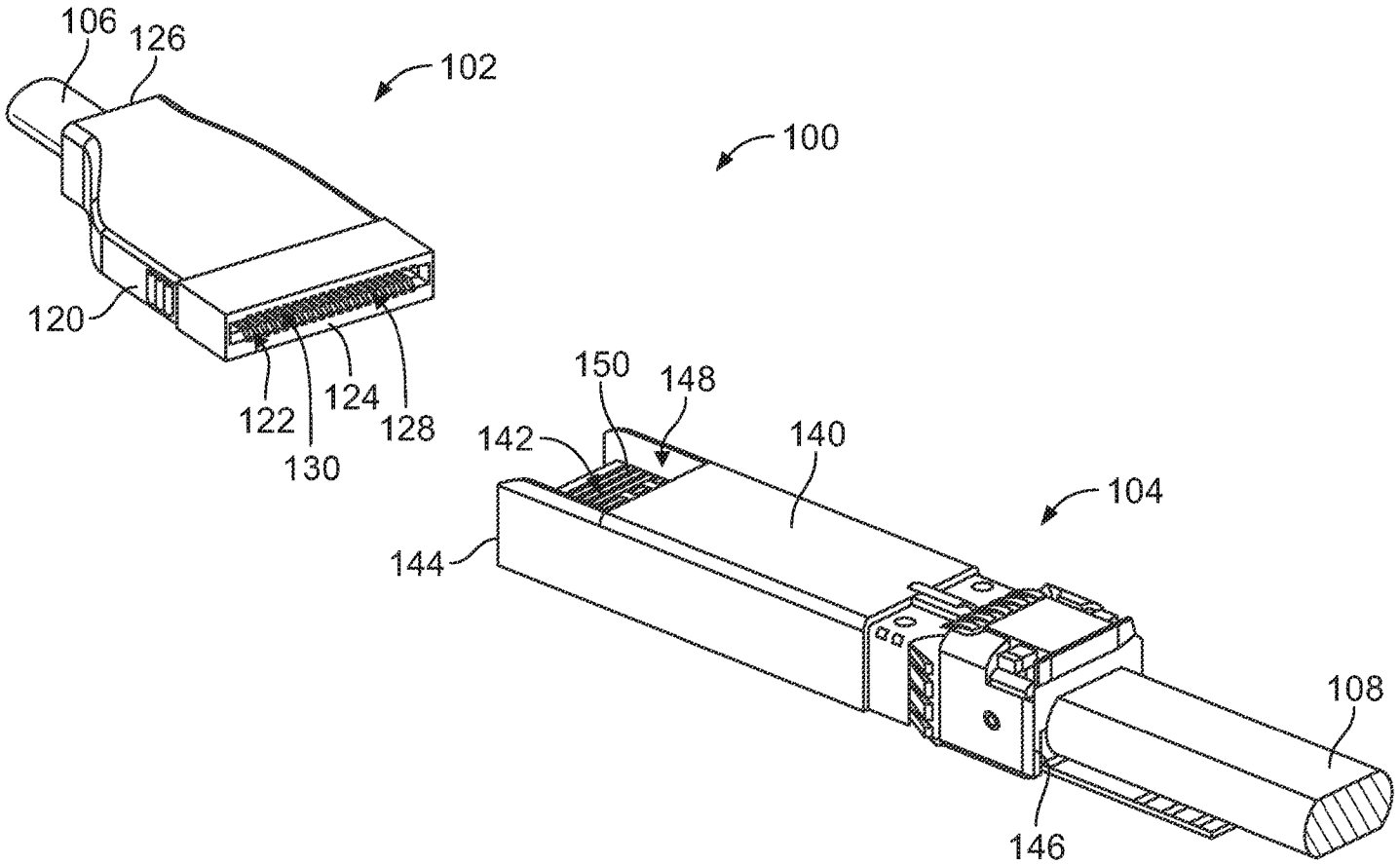
FIG. 1 is a perspective view of an electrical system 100 having electrical devices 102, 104 for providing data communication.

FIG. 1 is a perspective view of an electrical system 100 having electrical devices 102, 104 for providing data communication. The first electrical device 102 is provided at an end of a cable 106. The second electrical device 104 is provided at an end of a cable 108. In an exemplary embodiment, the electrical devices 102, 104 are communication devices, such as serial attached SCSI (SAS) connectors, serial ATA (SATA) connectors, and the like. However, the electrical devices 102, 104 may be other types of electrical connectors in an alternative embodiment. In the illustrated embodiment, the electrical device 102 is a receptacle connector and the electrical device 104 is a plug connector. The receptacle and plug connectors define mating connectors for each other having complementary mating interfaces configured to be electrically mated. The electrical device 102 may be a socket connector having a card slot and the electrical device 104 may be a card edge connector having a circuit card configured to be received in the card slot defined by the socket connector.

The electrical device 102 includes a housing 120 and conductors 122 arranged in the housing 120 for mating with the mating electrical device 104. The conductors 122 are electrically connected to the cable 106. In an exemplary embodiment, the conductors 122 include signal conductors and ground conductors. Other types of conductors, such as power conductors, may be provided in alternative embodiments. The housing 120 has a mating end 124 for mating with the mating electrical device 104 and a cable end 126 opposite the mating end 124. The cable 106 extends from the cable end 126. The housing 120 has a cavity 128. The conductors 122 are arranged within the cavity 128. The conductors 122 are terminated to the cable 106 in the cavity 128.

In an exemplary embodiment, the electrical device 102 includes a card slot 130 at the mating end 124. The card slot 130 provides access to the cavity 128. The card slot 130 is configured to receive a portion of the mating electrical device 104, such as a circuit card of the mating electrical device 104.

The electrical device 104 includes a housing 140 and conductors 142 arranged in the housing 140 for mating with the mating electrical device 102. The conductors 142 are electrically connected to the cable 108. In an exemplary embodiment, the conductors 142 include signal conductors and ground conductors. Other types of conductors, such as power conductors, may be provided in alternative embodiments. The housing 140 has a mating end 144 for mating with the mating electrical device 102 and a cable end 146 opposite the mating end 144. The cable 108 extends from the cable end 146. The housing 140 has a cavity 148. The conductors 142 are arranged within the cavity 148. The conductors 142 are terminated to the cable 108 in the cavity 148.

In an exemplary embodiment, the electrical device 102 includes a circuit card 150 at the mating end 144. The conductors 142 are provided on the circuit card 150. The circuit card 150 is configured to be plugged into the card slot 130 of the mating electrical device 102.

Figure 2:
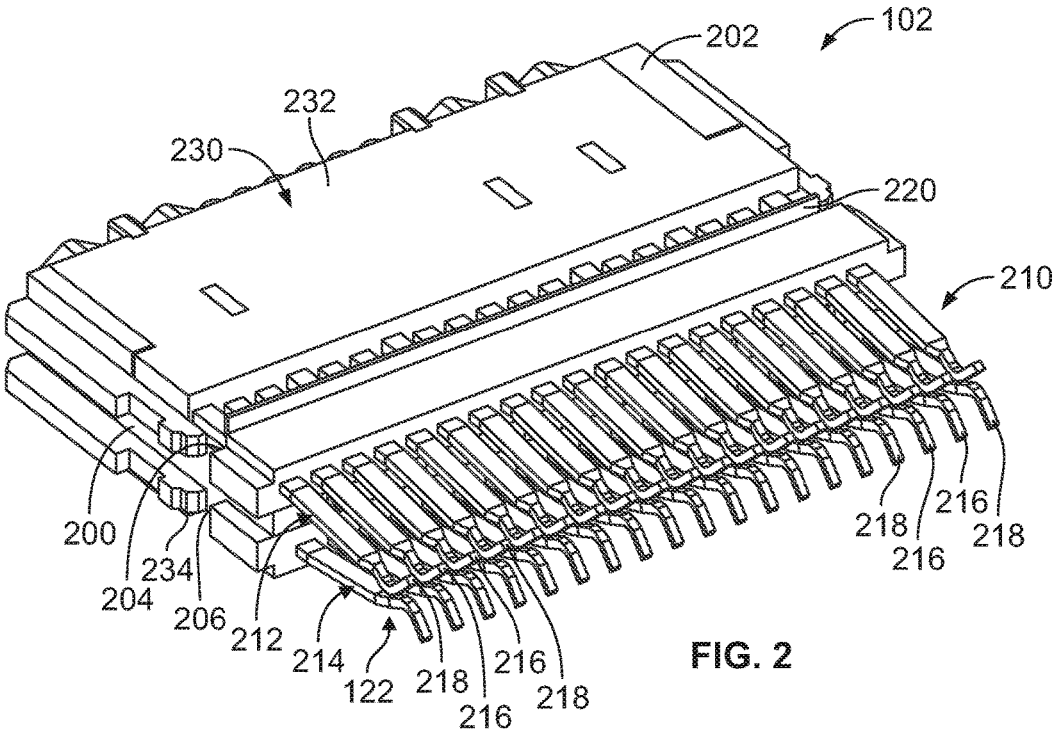
FIG. 2 is a perspective view of a portion of the electrical device 102 formed in accordance with one embodiment.

FIG. 2 is a perspective view of a portion of the electrical device 102 formed in accordance with one embodiment. The electrical device 102 includes an organizer 200 receiving the cables 106 and supporting the conductors 122. The organizer 200 includes a dielectric body 202 having an upper surface 204 and a lower surface 206. The organizer 200 supports ends of the cables 106 on the upper surface 204 and on the lower surface 206. The organizer 200 supports the conductors 122 on the upper surface 204 and on the lower surface 206.

In the illustrated embodiment, the conductors 122 are contacts 210. The contacts 210 are arranged in an upper contact array 212 and a lower contact array 214. The contacts 210 of the upper contact array 212 are provided on the upper surface 204 of the organizer 200 and the contacts 210 of the lower contact array 214 are provided on the lower surface 206 of the organizer 200. In an exemplary embodiment, the contacts 210 include signal contacts 216 and ground contacts 218. The ground contacts 218 provide electrical shielding between corresponding signal contacts 216. For example, the signal contacts 216 may be arranged in pairs and the ground contacts 218 may separate each of the pairs of signal contacts 216.

The electrical device 102 includes ground bus bars 220 on the upper surface 204 and on the lower surface 206. The ground bus bars 220 are electrically grounded to the cables 106. The ground bus bars 220 are electrically connected to corresponding ground contacts 218.

The electrical device 102 includes an impedance control body 230 coupled to the dielectric body 202 of the organizer 200. The impedance control body 230 includes an upper pad 232, a lower pad 234 and one or more connecting tabs 236 (illustrated in cross section in FIG. 6 below). The upper pad 232 is provided on the upper surface 204 of the organizer 200. The upper pad 232 covers at least a portion of each contact 210 of the upper contact array 212. The upper pad 232 covers at least a portion of each cable 106 supported by the upper surface 204. The lower pad 234 is provided on the lower surface 206 of the organizer 200. The lower pad 234 covers at least a portion of each contact 210 of the lower contact array 214. The lower pad 234 covers at least a portion of each cable 106 supported by the lower surface 206. In an exemplary embodiment, the impedance control body 230 is injection molded in situ on the organizer 200. The upper pad 232 is molded in place on the upper surface 204, the lower pad 234 is molded in place on the lower surface 206, and the connecting tabs 236 pass through the organizer 200 to tie the upper pad 232 to the lower pad 234 making a robust structure with the organizer 200 around the contacts 210 and the cables 106. The impedance control body 230 may be molded over the cables 106 to secure the cables 106 to the organizer 200 and provide strain relief for the cables 106.

The upper and lower pads 232, 234 surround portions of the signal lines for impedance control along such transmission lines. The amount of overlap of the impedance control body 230 with the signal lines (for example, along the contacts 210 and/or along signal wires of the cables 106) affects impedance characteristics of the signals transmitted along the signal lines. Additionally, the amount of the signal lines exposed to air, as opposed to being covered by the material of the impedance control body 230, affects impedance characteristics of the signals transmitted along the signal lines. The amount or length of coverage of the impedance control body 230 along the contacts 210 and/or along the signal wires of the cables 106 may be selected based on the total length of the signal lines, thus controlling the length of the signal lines being covered and the length of the signal lines being exposed to air. The material selected for the impedance control body 230 affects impedance characteristics of the signals transmitted along the signal lines. The positioning of the impedance control body 230 relative to the contacts 210 and the signal wires of the cables 106 may be precisely and repeatably controlled, providing better impedance control for the electrical device 102. For example, the position of the impedance control body 230 relative to the organizer 200 may be repeatably and precisely controlled during manufacture.

Figure 3:
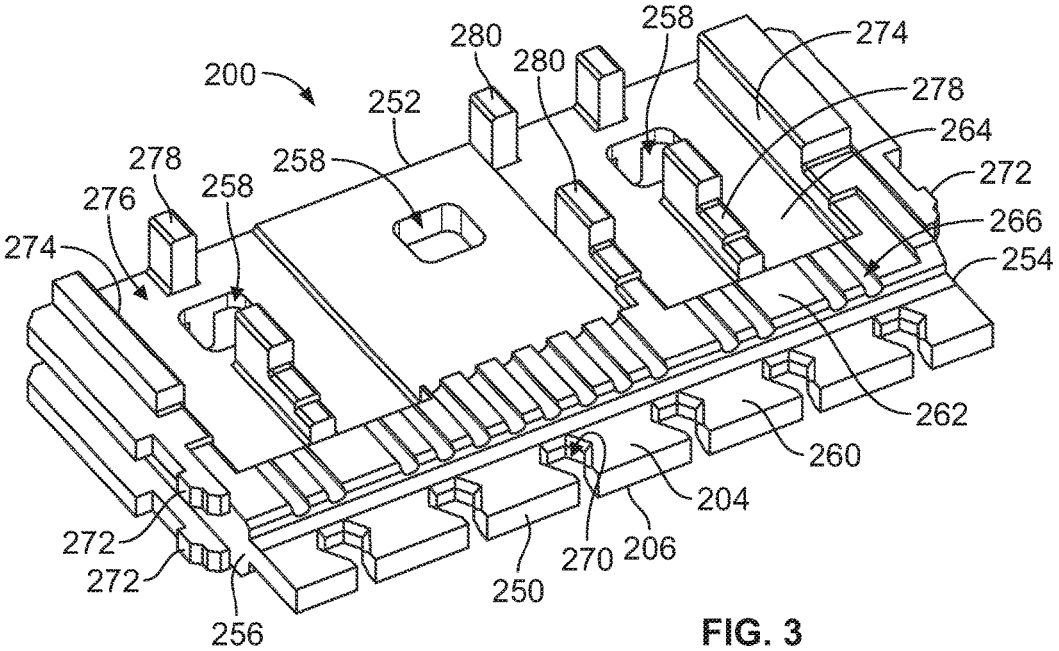
FIG. 3 is a perspective view of the organizer 200 in accordance with an exemplary embodiment.

FIG. 3 is a perspective view of the organizer 200 in accordance with an exemplary embodiment. In an exemplary embodiment, the organizer 200 is a molded part manufactured from a dielectric material. The organizer 200 extends between a front 250 and a rear 252. The organizer 200 includes a first side 254 and a second side 256.

In an exemplary embodiment, the organizer 200 includes one or more voids 258 passing through the organizer 200 between the upper surface 204 and the lower surface 206. The voids 258 receive the connecting tabs 236 (shown in phantom in FIG. 2). For example, the voids 258 provide a space for the material forming the impedance control body 230 (shown in FIG. 2) to flow between the upper surface 204 and the lower surface 206 during the injection molding process used for forming the impedance control body 230. When the connecting tabs 236 pass through the voids 258, the impedance control body 230 is locked together with the organizer 200. For example, the dielectric body 202 entirely surrounds the voids 258, thus locking the connecting tabs 236 and the corresponding voids 258. Any number of the voids 258 may be provided. The voids 258 may be provided proximate to the rear 252 and/or proximate to the front 250.

The organizer 200 includes front lands 260 proximate to the front 250, wire lands 262 rearward of the front lands 260 and cable lands 264 rearward of the wire lands 262. The front lands 260 are configured to support the upper and lower contact arrays 212, 214 (shown in FIG. 2). The cable lands 264 are configured to support the cables 106 (shown in FIG. 2). The wire lands 262 are configured to support wires of the cables 106. In an exemplary embodiment, the wire lands 262 include cradles 266 configured to receive corresponding wires. The cradles 266 are sized and shaped to support the wires and position the wires for mating with the upper and lower contact arrays 212, 214.

In an exemplary embodiment, the organizer 200 includes openings 270 in the front lands 260. The openings 270 are configured to receive portions of the upper and lower contact arrays 212, 214 to position the upper and lower contact arrays 212, 214 relative to the organizer 200. The openings 270 may have any shape depending on the particular application and corresponding upper and lower contact arrays 212, 214. In the illustrated embodiment, the openings 270 are hexagonal shaped; however, the openings 270 may have other shapes in alternative embodiments, such as cylindrical shapes.

In an exemplary embodiment, the organizer 200 includes latching features 272 along the first and second sides 254, 256. The latching features 272 are used to position and secure the organizer 200 in the housing 120 (shown in FIG. 1).

In an exemplary embodiment, the organizer 200 includes sidewalls 274 along the upper surface 204 and the lower surface 206 defining pockets 276 on the upper surface 204 and on the lower surface 206. The pockets 276 may be defined along the cable lands 264. The pockets 276 are configured to receive the upper and lower pads 232, 234 (shown in FIG. 2). The organizer 200 includes separating walls 278 in the pockets 276 between the sidewalls 274. The separating walls 278 subdivide the pocket 276 into cable pockets. The separating walls 278 are configured to separate cables 106 from each other. In an exemplary embodiment, the organizer 200 includes locking posts 280. For example, the locking posts 280 may extend from the separating walls 278. The locking posts 280 are configured to be embedded in the material of the impedance control body 230 to lock the impedance control body 230 to the organizer 200.

Figure 4:
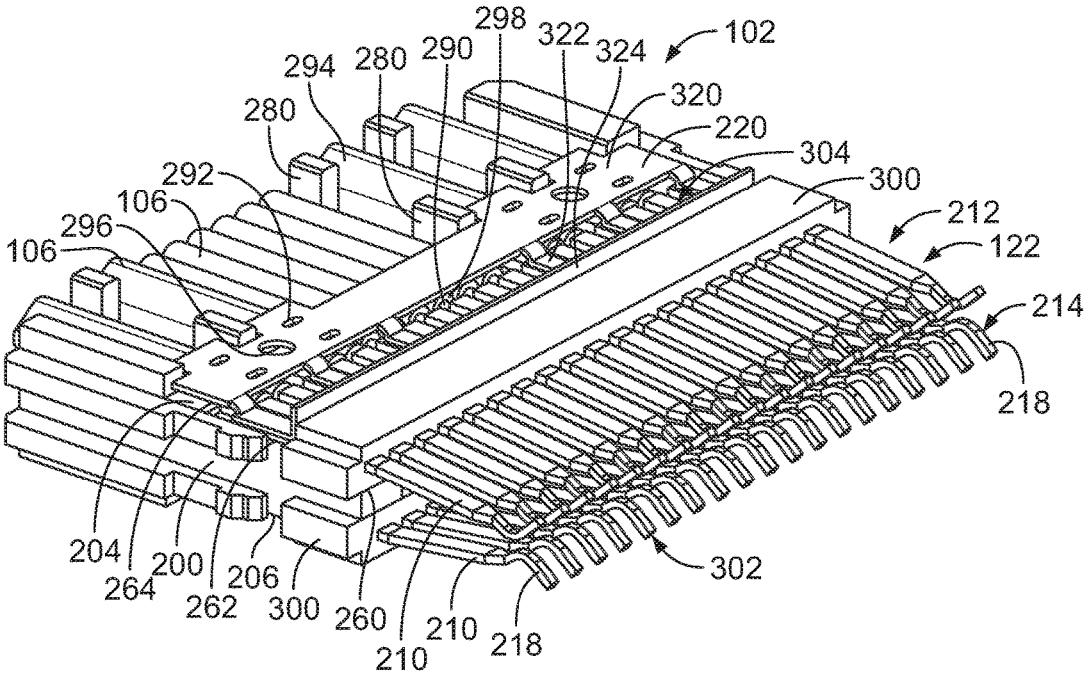
FIG. 4 is a perspective view of the electrical device 102 in accordance with an exemplary embodiment with the impedance control body 230 (shown in FIG. 2) removed to illustrate other components of the electrical device 102.

FIG. 4 is a perspective view of the electrical device 102 in accordance with an exemplary embodiment with the impedance control body 230 (shown in FIG. 2) removed to illustrate other components of the electrical device 102. During assembly, ends of the cables 106 are stripped to expose wires of the cables 106. For example, the cables 106 may include signal wires 290 and/or ground wires 292 (for example, drain wires). The cables 106 include outer jackets 294. In an exemplary embodiment, the cables 106 include ground shields 296, such as cable braids, and insulators 298 between the signal wires 290 and the ground shields 296. The cables 106 may be coaxial cables having a single signal wire 290 or twin axial cables having a pair of signal wires 290 within the outer jacket 294. In the illustrated embodiment, the electrical device 102 includes different types of cables 106, such as low speed cables in the form of coaxial cables and high-speed cables in the form of twin axial cables. Other arrangements are possible in alternative embodiments.

During assembly, the cables 106 are coupled to the organizer 200 along the upper surface 204 and/or the lower surface 206. For example, the cables 106 are routed along the cable lands 264 and the signal wires 290 extend along the wire lands 262. The upper and lower contact arrays 212, 214 may be coupled to the organizer 200 to electrically connect the contacts 210 to the signal wires 290 and the ground bus bar 220. The upper and lower contact arrays 212, 214 include dielectric holders 300 holding the contacts 210. The dielectric holder 300 may be overmolded over the contacts 210. The dielectric holder 300 is coupled to the organizer 200 at the front land 260. Locating posts are configured to extend from the dielectric holder 300 into the openings 270 and the organizer 200. Optionally, the upper contact array 212 may be separate and discrete from the lower contact array 214 being separately manufactured and separately coupled to the organizer 200. Alternatively, the upper contact array 212 and the lower contact array 214 may be integral with the dielectric holders 300, molded as a monolithic structure around the corresponding contacts 210.

The contacts 210 may be stamped and formed contacts. The contacts 210 extend between a mating end 302 and a terminating end 304. The terminating end 304 is configured to be electrically connected to the corresponding signal wire 290 or ground wire 292 and/or the ground bus bar 220. The terminating end 304 may be soldered to the signal wire 290 or the ground wire 292; however, the terminating end 304 may be terminated by other means in alternative embodiments. The mating end 302 extends forward of the dielectric holder 300 for mating with the mating electrical device 104 (shown in FIG. 1). Optionally, the contacts 210 may include deflectable spring beams at the mating ends 302. The mating ends 302 are cantilevered from the dielectric holders 300. The distal ends of the contacts 210 may be curved outward for loading the circuit card or other mating component between the contacts 210 of the upper and lower contact arrays 212, 214. The mating ends 302 include mating interfaces proximate to the distal ends. The mating interfaces may be curved. The mating interfaces define separable mating interfaces.

The ground bus bars 220 are coupled to the organizer 200 on the upper surface 204 and the lower surface 206. Each ground bus bar 220 includes a base 320 and ground contacts 322 extending forward from the base 320. The ground contacts 322 are configured to electrically connect with corresponding ground contacts 218. For example, the ground contacts 322 may be spring biased against the terminating ends 304 of the ground contacts 218. The ground contacts 322 may be soldered to the ground contacts 218. The ground contacts 322 may be terminated to the ground contacts 218 by other means in alternative embodiments. In an exemplary embodiment, the ground bus bar 220 includes a tie bar 324 connecting all of the ground contacts 322 together. The tie bar 324 is located at the front ends of the ground contacts 322. Optionally, the tie bar 324 may be positioned to abut against the dielectric holder 300. In an exemplary embodiment, the base 320 is configured to be electrically connected to the ground shields 296 of the cables 106. For example, portions of the outer jacket 294 may be removed exposing the ground shields 296. The base 320 may be in direct electrical contact with the ground shields 296. The base 320 may be crimped to the ground shields 296. The base 320 may be soldered to the ground shields 296. Optionally, the base 320 may be electrically connected to corresponding ground wires 292 of the cables 106. For example, the base 320 may include insulation displacement contacts configured to electrically connect with corresponding ground wires 292. Alternatively, the base 320 may include spring beams or other features configured to electrically connect to the ground wires 292.

Once assembled, the electrical device 102 is configured to receive the impedance control body 230. For example, the impedance control body 230 may be molded over portions of the cables 106, portions of the ground bus bar 220, portions of the signal wires 290, portions of the ground wires 292, portions of the contacts 210, and/or portions of the organizer 200. The impedance control body 230 is configured to embed portions of the conductors 122 and portions of the cables 106. The impedance control body 230 is secured to the organizer 200 by flowing through the voids 258 (shown in FIG. 3). The impedance control body 230 is secured to the organizer 200 by surrounding corresponding locking posts 280. The impedance control body 230 is secured to the organizer 200 by engaging walls, surfaces, shoulders and the like of the organizer 200 to lock the position of the impedance control body 230 relative to the organizer 200.

Figure 5:
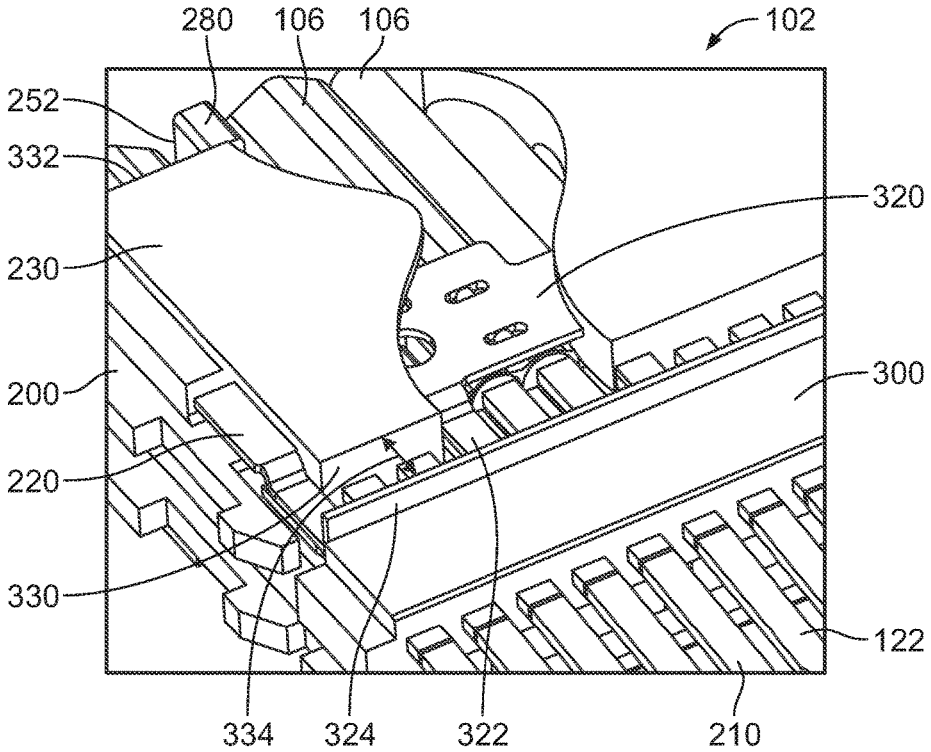
FIG. 5 is a perspective view of a portion of the electrical device 102 with a portion of the impedance control body 230 removed to illustrate other components of the electrical device 102.

FIG. 5 is a perspective view of a portion of the electrical device 102 with a portion of the impedance control body 230 removed to illustrate other components of the electrical device 102. The impedance control body 230 is molded in place on the organizer 200 around the conductors 122 and the cables 106. The material of the impedance control body 230 flows around and between the cables 106 and cures or hardens in place. The material of the impedance control body 230 flows around and between the signal wires 290 and cures or hardens in place. The material of the impedance control body 230 flows around and between portions of the ground contacts 322 of the ground bus bar 220 and cures or hardens in place. The material of the impedance control body 230 flows around the base 320 of the ground bus bar 220 and cures or hardens in place. The material of the impedance control body 230 flows around and between portions of the contacts 210 and cures or hardens in place. The material of the impedance control body 230 flows around the locking posts 280 and cures or hardens in place. The material of the impedance control body 230 flows through the voids 258 and cures or hardens in place.

The impedance control body 230 includes a front edge 330 and a rear edge 332. The rear edge 332 may be provided at or near the rear 252 of the organizer 200. The cables 106 extend rearward of the rear edge 332 of the impedance control body 230. The front edge 330 of the impedance control body 230 is positioned at the terminating interface between the contacts 210 and the signal wires 290 such that the impedance control body at least partially covers the signal wires 290 and at least partially covers the contacts 210. Optionally, the front edge 330 may be spaced apart, rearward of, the tie bar 324 and the dielectric holder's 300. Optionally, the front edge 330 may be spaced apart a predetermined distance 340 from the dielectric holder 300 to control the amount (for example, the length) of the contacts 210 that are covered by the impedance control body 230. By controlling the distance 340 the impedance of the transmission line may be controlled. For example, a predetermined length of the contacts 210 may be covered by the impedance control body 230 and a predetermined length of the contacts 210 may be exposed to air between the impedance control body 230 and the dielectric holder 300. By controlling the length of the contacts 210 that are covered compared to the length of the contacts 210 that are exposed to air, the impedance of the transmission lines may be controlled.

Figure 6:
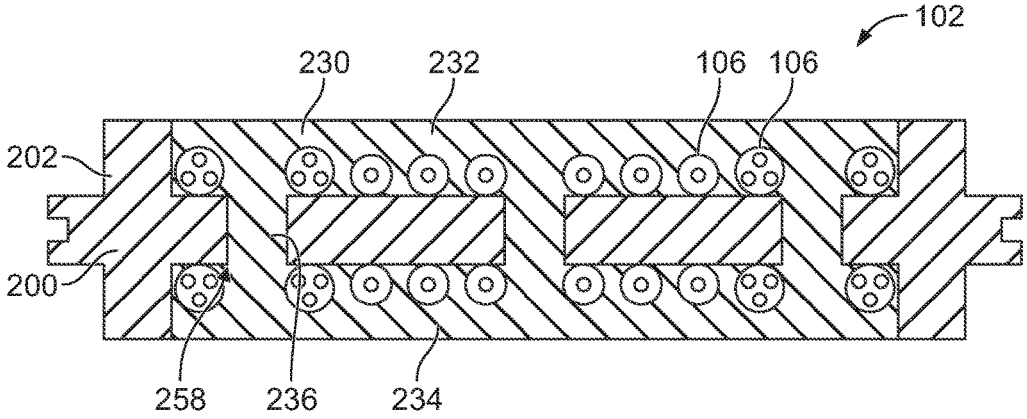
FIG. 6 is a cross-sectional view of the electrical device 102 in accordance with an exemplary embodiment.

FIG. 6 is a cross-sectional view of the electrical device 102 in accordance with an exemplary embodiment. FIG. 6 illustrates the impedance control body 230 relative to the organizer 200 and the cables 106. The cross-section shown in FIG. 6 is through the voids 258 illustrating the connecting tabs 236 of the impedance control body 230 between the upper pad 232 and the lower pad 234. The impedance control body 230 is secured to the organizer 200 by the connecting tabs 236. For example, the upper pad 232 is secured to the lower pad 234 by the connecting tabs 236 the dielectric body 202 of the organizer 200 between the upper and lower pads 232, 234. The material of the impedance control body 230 at least partially surrounds the cables 106 to secure the cables 106 to the organizer 200. The impedance control body 230 provides strain relief for the cables 106.

Figure 7:
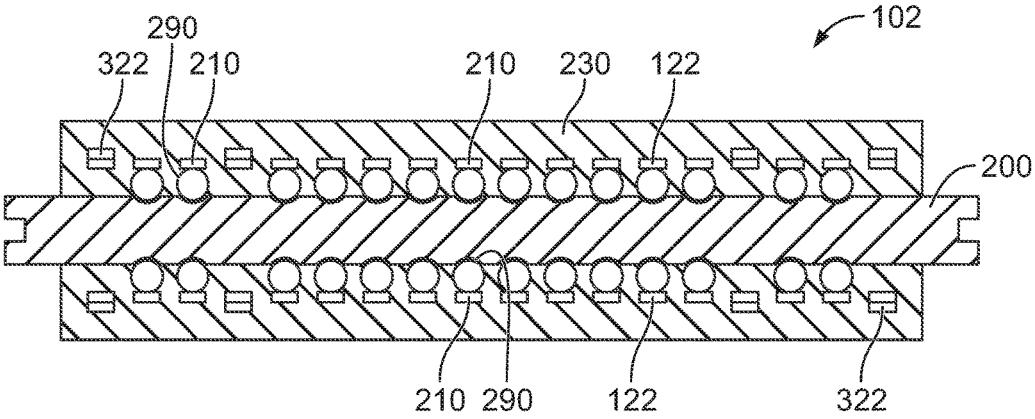
FIG. 7 is a cross-sectional view of the electrical device 102 in accordance with an exemplary embodiment.

FIG. 7 is a cross-sectional view of the electrical device 102 in accordance with an exemplary embodiment. FIG. 7 illustrates the impedance control body 230 relative to the organizer 200 and the conductors 122. The cross-section shown in FIG. 6 is through the contacts 210 and the ground contacts 322. The material of the impedance control body 230 at least partially surrounds the signal wires 290 and the contacts 210.

Figure 8:
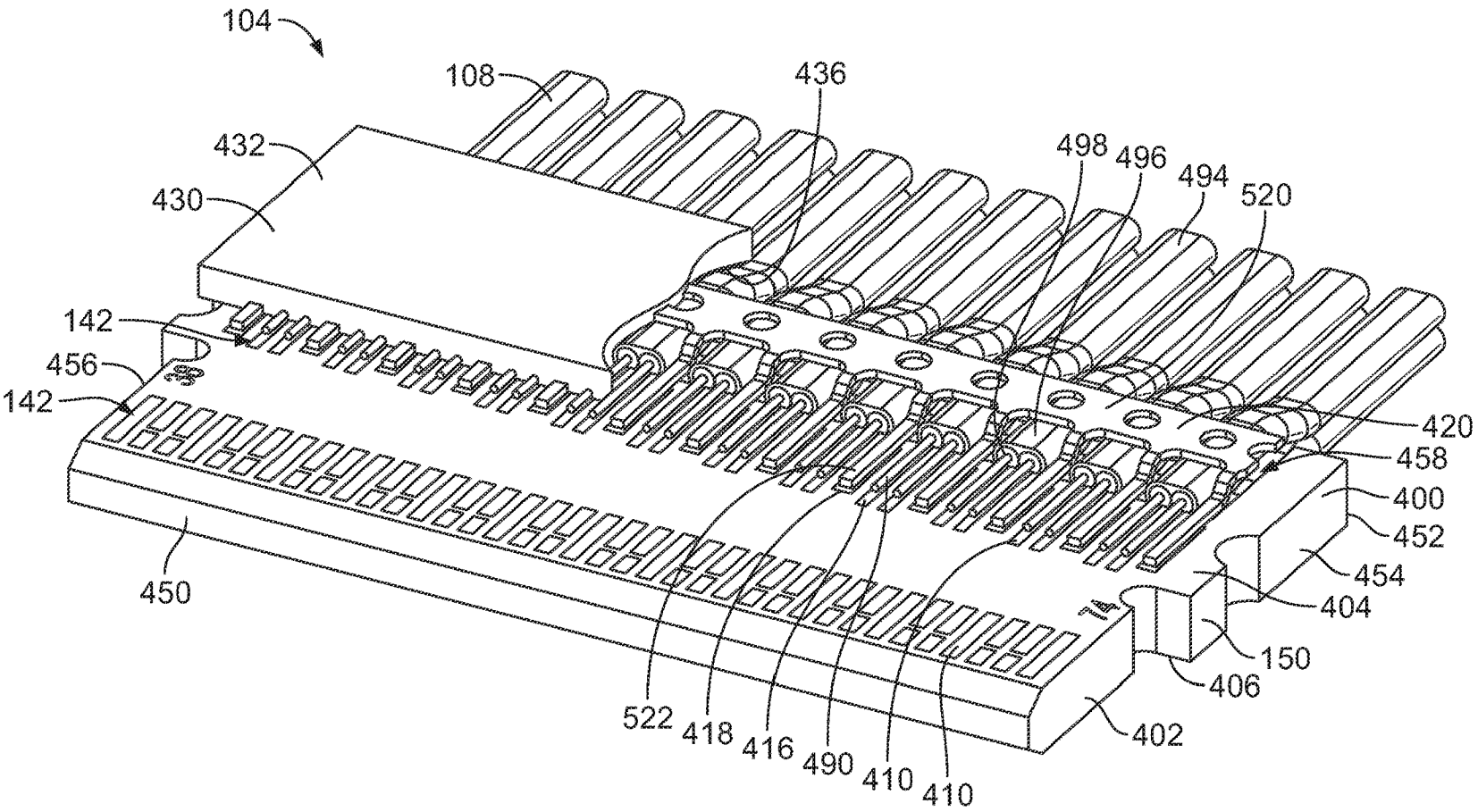
FIG. 8 is a perspective view of a portion of the electrical device 104 formed in accordance with one embodiment.

FIG. 8 is a perspective view of a portion of the electrical device 104 formed in accordance with one embodiment. The electrical device 104 is a card edge connector including the circuit card 150. The circuit card 150 includes an organizer 400 receiving the cables 108 and supporting the conductors 142. The organizer 400 includes a substrate or board defined by a dielectric body 402 having an upper surface 404 and a lower surface 406. The dielectric body 402 may be a layered structure, such as a layered circuit board. The dielectric body 402 may be manufactured from FR-4 or other circuit board material. The conductors 142 are formed with the board as circuits, such as traces, pads, vias, and the like. The conductors 142 are provided on the upper surface 404, on the lower surface 406, and/or on one or more other layers of the board. The organizer 400 supports ends of the cables 108 on the upper surface 404 and on the lower surface 406.

In the illustrated embodiment, the conductors 142 are traces 410. The conductors 142 include signal conductors 416 and ground conductors 418. The ground conductors 418 provide electrical shielding between corresponding signal conductors 416. For example, the signal conductors 416 may be arranged in pairs and the ground conductors 418 may separate each of the pairs of signal conductors 416. The ground conductors 418 may be electrically connected to a ground plane of the circuit card 150.

The electrical device 104 includes ground bus bars 420 on the upper surface 404 and on the lower surface 406. The ground bus bars 420 are electrically grounded to the cables 108. The ground bus bars 420 are electrically connected to corresponding ground conductors 418.

The electrical device 104 includes an impedance control body 430 (a portion of which is removed to illustrate other components) coupled to the dielectric body 402 of the organizer 400. The impedance control body 430 includes upper and lower pads 432 and one or more connecting tabs 436. The upper pad 432 is provided on the upper surface 404 of the organizer 400. The upper pad 432 covers at least a portion of each conductor 142 on the upper surface 404. The upper pad 432 covers at least a portion of each cable 108 supported by the upper surface 404. The lower pad 432 is provided on the lower surface 406 of the organizer 400. The lower pad 432 covers at least a portion of each conductor 142 on the lower surface 406. The lower pad 432 covers at least a portion of each cable 108 supported by the lower surface 406. In an exemplary embodiment, the impedance control body 430 is injection molded in situ on the organizer 400. The upper pad 432 is molded in place on the upper surface 404, the lower pad 432 is molded in place on the lower surface 406, and the connecting tabs 436 pass through the organizer 400 to tie the upper pad 432 to the lower pad 432 making a robust structure with the organizer 400 around the conductors 142 and the cables 108. The impedance control body 430 may be molded over the cables 108 to secure the cables 108 to the organizer 400 and provide strain relief for the cables 108.

The upper and lower pads 432, 432 surround portions of the signal lines for impedance control along such transmission lines. The amount of overlap of the impedance control body 430 with the signal lines (for example, along the conductors 142 and/or along signal wires of the cables 108) affects impedance characteristics of the signals transmitted along the signal lines. Additionally, the amount of the signal lines exposed to air, as opposed to being covered by the material of the impedance control body 430, affects impedance characteristics of the signals transmitted along the signal lines. The amount or length of coverage of the impedance control body 430 along the conductors 142 and/or along the signal wires of the cables 108 may be selected based on the total length of the signal lines, thus controlling the length of the signal lines being covered and the length of the signal lines being exposed to air. The material selected for the impedance control body 430 affects impedance characteristics of the signals transmitted along the signal lines. The positioning of the impedance control body 430 relative to the conductors 142 and the signal wires of the cables 108 may be precisely and repeatably controlled, providing better impedance control for the electrical device 104. For example, the position of the impedance control body 430 relative to the organizer 400 may be repeatably and precisely controlled during manufacture, such as using molds or tooling.

The organizer 400 extends between a front 450 and a rear 452. The organizer 400 includes a first side 454 and a second side 456. In an exemplary embodiment, the organizer 400 includes one or more voids 458 passing through the organizer 400 between the upper surface 404 and the lower surface 406. In the illustrated embodiment, the organizer include a single void at the rear 452 that receives each of the cables 108. The void 458 receives the connecting tab 436. For example, the void 458 provides a space for the material forming the impedance control body 430 to flow between the upper surface 404 and the lower surface 406 during the injection molding process used for forming the impedance control body 430. When the connecting tab 436 passes through the void 458, the impedance control body 430 is locked together with the organizer 400. For example, the upper pad 432 is above the dielectric body 402 and the lower pad 432 is below the dielectric body 402, thus locking the impedance control body 430 to the organizer 400.

During assembly, ends of the cables 108 are stripped to expose wires of the cables 108. For example, the cables 108 may include signal wires 490 and/or ground wires (for example, drain wires). The cables 108 include outer jackets 494. In an exemplary embodiment, the cables 108 include ground shields 496, such as cable braids, and insulators 498 between the signal wires 490 and the ground shields 496. The cables 108 may be coaxial cables having a single signal wire 490 or twin axial cables having a pair of signal wires 490 within the outer jacket 494. During assembly, the cables 108 are coupled to the organizer 400 along the upper surface 404 and the lower surface 406.

The ground bus bars 420 are coupled to the organizer 400 on the upper surface 404 and the lower surface 406. Each ground bus bar 420 includes a base 520 and ground contacts 522 extending forward from the base 520. The ground contacts 522 are configured to electrically connect with corresponding ground conductors 418. For example, the ground contacts 522 may be spring biased against the ground conductors 418. The ground contacts 522 may be soldered to the ground conductors 418. The ground contacts 522 may be terminated to the ground conductors 418 by other means in alternative embodiments. In an exemplary embodiment, the base 520 is configured to be electrically connected to the ground shields 496 of the cables 108. For example, portions of the outer jacket 494 may be removed exposing the ground shields 496.

Once assembled, the electrical device 104 is configured to receive the impedance control body 430. For example, the impedance control body 430 may be molded over portions of the cables 108, portions of the ground bus bar 420, portions of the signal wires 490, portions of the ground wires, portions of the conductors 142, and/or portions of the organizer 400. The impedance control body 430 is configured to embed portions of the cables 108. The impedance control body 430 is secured to the organizer 400 by flowing through the void 458.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical device comprising:

cables having signal wires;

an organizer having a dielectric body including an upper surface and a lower surface, the organizer supporting ends of the cables on the upper surface and on the lower surface, the organizer having a void extending between the upper surface and the lower surface;

conductors on the upper surface and on the lower surface, the conductors having mating ends configured for mating with a mating electrical device, the conductors being electrically connected to corresponding signal wires; and an impedance control body coupled to the dielectric body of the organizer, the impedance control body having an upper pad on the upper surface directly engaging and covering at least a portion of each conductor on the upper surface and the upper pad directly engaging and covering at least a portion of each signal wire of the cables supported by the upper surface, the impedance control body having a lower pad on the lower surface directly engaging and covering at least a portion of each conductor on the lower surface and the lower pad directly engaging and covering at least a portion of each signal wire of the cables supported by the lower surface, the impedance control body having a connecting tab passing through the void between the upper pad and the lower pad, the impedance control body being separate and discrete from the dielectric body of the organizer.

2. The electrical device of claim 1, wherein the impedance control body is a dielectric material being injection molded in situ on the organizer.

3. The electrical device of claim 1, wherein a length of covering of the conductors by the impedance control body is less than a total length of the conductor and selected based on the total length of the conductors with an uncovered length of the conductors being exposed to air to control the impedance of the signals transmitted by the conductors based on the covered length of the conductors and the uncovered length of the conductors.

4. The electrical device of claim 1, wherein the impedance control body fills the void.

5. The electrical device of claim 1, wherein the void is a through hole surrounded by the dielectric body, the impedance control body passing through the void to lock the upper pad and the lower pad to the organizer.

6. The electrical device of claim 1, wherein the impedance control body covers a termination interface between the conductors and the signal wires.

7. The electrical device of claim 1, wherein the upper pad, the lower pad and the connecting tab are an integral monolithic structure.

8. The electrical device of claim 1, wherein the organizer includes a locking post, the impedance control body being formed around the locking post to secure the impedance control body to the organizer.

9. The electrical device of claim 1, wherein the organizer includes an upper pocket defined between upper sidewalls and the organizer includes a lower pocket defined between lower sidewalls, the upper pad being received in the upper pocket, the lower pad being received in the lower pocket.

10. The electrical device of claim 1, wherein the signal wires are exposed at the ends of the cables beyond a cable jacket of the corresponding cable, the impedance control body covering the entire exposed signal wire and covering at least a length of the cable jacket of each cable.

11. The electrical device of claim 1, wherein the impedance control body extends between adjacent signal wires.

12. The electrical device of claim 1, wherein the cables include ground shields, the electrical device further comprising a ground bus bar having a base electrically connected to a plurality of the ground shields, the ground bus bar having ground contacts extending from the base being electrically connected to corresponding conductors, the impedance control body covering the base and at least a portion of each of the ground contacts.

13. The electrical device of claim 12, wherein the signal wires are arranged in pairs and the corresponding conductors are arranged in pairs, the ground contacts being positioned between corresponding pairs of the conductors.

14. The electrical device of claim 1, wherein the impedance control body engages the cables to secure the cables relative to the organizer to provide strain relief at the termination of the signal wires to the conductors.

15. The electrical device of claim 1, wherein the conductors comprise contacts having mating ends and terminating ends, the terminating ends being terminated to corresponding signal wires, the mating ends having deflectable spring beams extending forward of the organizer and defining an upper contact array and a lower contact array configured to mate to opposite upper and lower surfaces of a circuit card.

16. The electrical device of claim 15, wherein the contacts of the upper contact array are coupled together by an upper dielectric holder and the contacts of the lower contact array are coupled together by a lower dielectric holder, the upper pad being spaced apart from the upper dielectric holder such that portions of the contacts are exposed between the upper pad and the upper dielectric holder, the lower pad being spaced apart from the lower dielectric holder such that portions of the contacts are exposed between the lower pad and the lower dielectric holder.

17. The electrical device of claim 1, wherein the organizer is a circuit card, the dielectric body of the organizer comprising a card substrate, the conductors comprising traces of the circuit card, the card substrate having a card edge configured to be plugged into a card edge slot of the mating electrical device.

18. An electrical device, comprising:

an organizer having a dielectric body including an upper surface and a lower surface, the organizer having a void extending between the upper surface and the lower surface;

upper conductors on the upper surface having mating ends configured for mating with a mating electrical device;

lower conductors on the lower surface having mating ends configured for mating with the mating electrical device;

upper cables supported by the upper surface, the upper cables having upper signal wires;

lower cables supported by the lower surface, the lower cables having lower signal wires; and an impedance control body coupled to the dielectric body of the organizer, the impedance control body having an upper pad on the upper surface directly engaging and covering at least a portion of each upper conductor and directly engaging and covering at least a portion of each upper signal wire, the impedance control body having a lower pad on the lower surface directly engaging and covering at least a portion of each lower conductor and directly engaging and covering at least a portion of each lower signal wire, the impedance control body having a connecting tab passing through the void between the upper pad and the lower pad, the impedance control body being separate and discrete from the dielectric body of the organizer.

19. The electrical device of claim 18, wherein the impedance control body is injection molded in situ on the organizer.

20. An electrical device comprising:

a housing having a cavity, the housing having a mating end, the housing having a slot at the mating end providing access to the cavity and configured to receive a mating electrical device;

cables extending from a cable end of the housing, each cable having a signal wire;

an organizer received in the cavity, the organizer having a dielectric body including an upper surface and a lower surface, the organizer supporting ends of the cables on the upper surface and on the lower surface, the organizer having a void extending between the upper surface and the lower surface;

conductors on the upper surface and on the lower surface, the conductors having mating ends arranged within the slot for mating with the mating electrical device, the conductors being electrically connected to corresponding signal wires; and an impedance control body separate and discrete from the dielectric body of the organizer and being coupled to the dielectric body of the organizer, the impedance control body having an upper pad, a lower pad and a connecting tab between the upper pad and the lower pad, the connecting tab passing through the void between the upper pad and the lower pad, the impedance control body directly engaging and covering at least a portion of each conductor and directly engaging and covering at least a portion of each signal wire of the cables.

* * * * *